US006631857B2

(12) United States Patent
Ibrahim et al.

(10) Patent No.: US 6,631,857 B2
(45) Date of Patent: Oct. 14, 2003

(54) PARTIALLY PLASTIC FUEL INJECTOR COMPONENT AND METHOD OF MAKING THE SAME

(75) Inventors: Dan R. Ibrahim, Bloomington, IL (US); Stephen T. Konwinski, El Paso, IL (US); Dale C. Maley, Fairbury, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/747,917

(22) Filed: Dec. 22, 2000

(65) Prior Publication Data

US 2002/0079385 A1 Jun. 27, 2002

(51) Int. Cl.[7] ..... F02M 61/20

(52) U.S. Cl. ..... 239/533.9; 239/533.3; 239/584; 239/600

(58) Field of Search ..... 239/1, 5, 533.2, 239/533.3, 533.9, 585.1, 585.4, 584, 591, 600; 29/890.143

(56) References Cited

U.S. PATENT DOCUMENTS

| | | | | |
|---|---|---|---|---|
| 4,481,699 A | * | 11/1984 | Knapp et al. | 239/600 |
| 4,967,966 A | | 11/1990 | Babitzka et al. | |
| 5,150,842 A | | 9/1992 | Hickey | |
| 5,168,857 A | | 12/1992 | Hickey | |
| 5,185,919 A | | 2/1993 | Hickey | |
| 5,189,782 A | | 3/1993 | Hickey | |
| 5,372,313 A | | 12/1994 | Chabon et al. | |
| 5,381,965 A | | 1/1995 | Chabon et al. | |
| 5,632,467 A | * | 5/1997 | Just et al. | 239/585.4 X |
| 5,769,328 A | * | 6/1998 | Zdyb et al. | 239/585.4 |
| 5,904,299 A | | 5/1999 | Hans et al. | |
| 5,915,626 A | | 6/1999 | Awarzamani et al. | |
| 5,979,866 A | * | 11/1999 | Baxter et al. | 239/585.1 X |
| 5,996,911 A | | 12/1999 | Gesk et al. | |
| 6,105,884 A | * | 8/2000 | Molnar et al. | 239/585.1 |
| 6,364,220 B2 | * | 4/2002 | Willke et al. | 239/585.1 |

FOREIGN PATENT DOCUMENTS

| | | |
|---|---|---|
| DE | 19641785 A1 | 4/1998 |
| EP | 0972932 A1 | 1/2000 |
| EP | 1113166 A2 | 7/2001 |

* cited by examiner

*Primary Examiner*—Steven J. Ganey
(74) *Attorney, Agent, or Firm*—Liell & McNeil

(57) ABSTRACT

Use of pump and line fuel injectors has become more common in fuel injection systems. While these fuel injectors do not typically include individual electrical actuators or fuel pressurization means, they still include a number of components that must be intricately machined in order for the fuel injector to perform as desired. The present invention is directed to reducing the number of machining steps, and therefore the cost, of producing such a fuel injector by utilizing a plastic component that can allow for a reliable and cost effective replacement of more intricately machined fuel injector components.

10 Claims, 2 Drawing Sheets

Fig. 1.
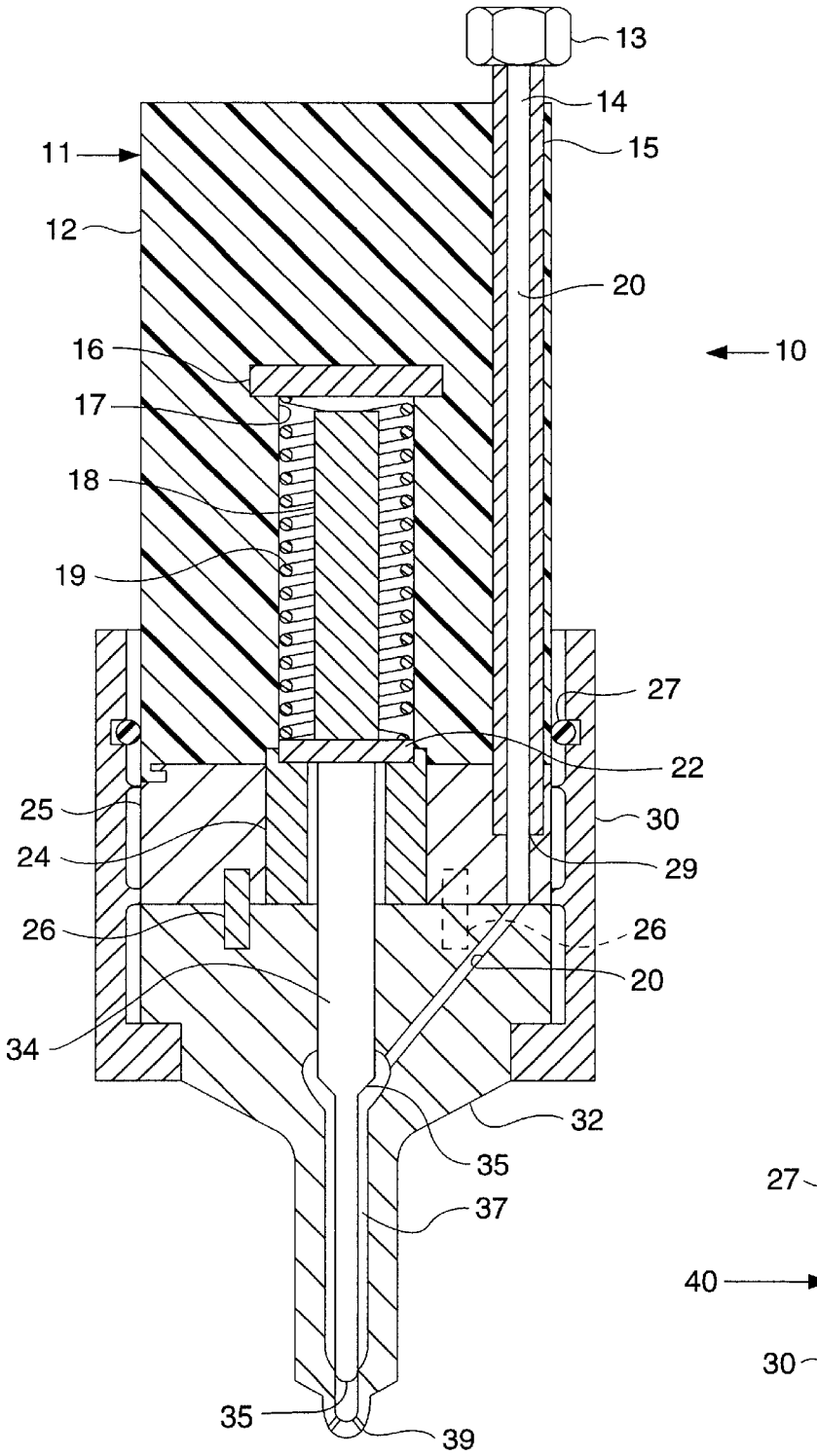
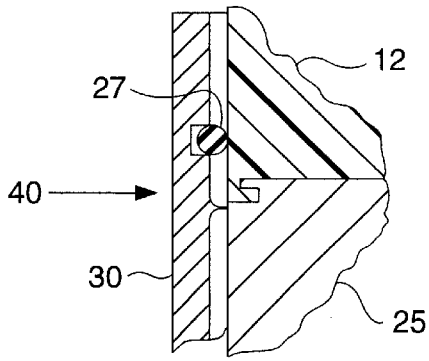
Fig. 1a.

PARTIALLY PLASTIC FUEL INJECTOR COMPONENT AND METHOD OF MAKING THE SAME

TECHNICAL FIELD

This invention relates generally to fuel injector components, and more particularly to fuel injector components having a metal tube at least partially surrounded by plastic.

BACKGROUND ART

Traditionally, fuel injector components are composed of steel or another metal that is capable of resisting the high amount of heat and pressure that exists within the fuel injector. Recently, however, engineers have begun constructing certain fuel injector components from plastic. One example of a fuel injector including a plastic component and a method of manufacturing the same is described in U.S. Pat. No. 5,150,842, which issued to Hickey on Sep. 29, 1992. While the method of manufacturing disclosed therein has produced a fuel injector that performs adequately, there is room for improvement. For instance, it is believed that the number of components included in a fuel injector can be reduced, thereby decreasing the cost of production, by replacing one or more fuel injector components with a plastic component.

The present invention is directed to overcoming one or more of the problems as set forth above.

DISCLOSURE OF THE INVENTION

In one aspect of the present invention, a fuel injector component includes a metal tube at least partially surrounded by plastic. The metal tube is attached to a metal component.

In another aspect of the present invention, a fuel injector includes an injector body that includes a metal component and defines a nozzle outlet. A needle valve member is movably positioned in the injector body. The metal tube is attached to the metal component and at least partially surrounded by plastic.

In yet another aspect of the present invention, a method of making a fuel injector component includes attaching a metal tube to a metal component. At least a portion of the metal tube is then surrounded by plastic.

BRIEF DESCRIPTION OF THE DRAWING

FIG. 1 is a sectioned side diagrammatic view of a fuel injector according to the preferred embodiment of the present invention;

FIG. 1*a* is a sectioned side view of the anchor region of the fuel injector of FIG. 1.

BEST MODE FOR CARRYING OUT THE INVENTION

Figure 2:
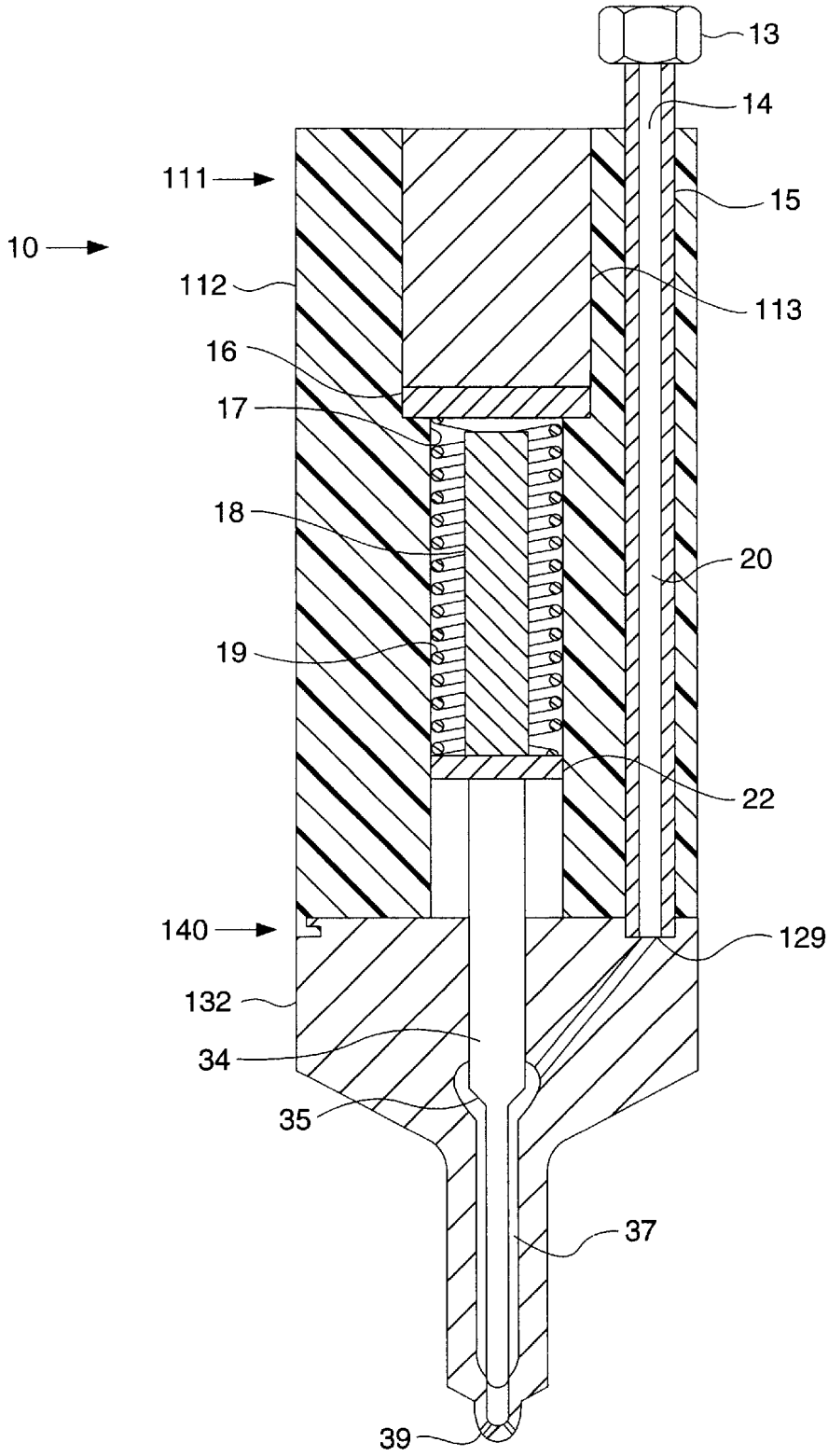
FIG. 2 is a sectioned side diagrammatic view of a fuel injector according to an alternate embodiment of the present invention.

Referring now to FIG. 1 there is shown a fuel injector 10 according to the preferred embodiment of the present invention. As illustrated, fuel injector 10 is preferably a nozzle assembly for use in a pump and line type fuel injection system. Fuel injector 10 provides an injector body 11 that has a metal tube 15 surrounded by a plastic component 12.

While metal tube 15 is preferably composed of steel, it should be appreciated that other suitable metallic alloys could be substituted. Metal tube 15 defines a nozzle supply passage 20 and has a first end defining a fuel inlet 14. The first end of metal tube 15 is attached to a coupling 13. Coupling 13 permits injector 10 to be connected to a source of high pressure fuel, such as a unit pump. A second end of metal tube 15 is attached to an interface plate 25 that is provided in injector body 11. Interface plate 25 is preferably composed of any suitable metal and defines a portion of nozzle supply passage 20. Plastic component 12 is preferably formed in an injection molding procedure that uses metal tube 15 and interface plate 25 as a portion of the core. Because of the usage of the metallic tube, the plastic need not have the ability to hold the relatively high injection pressures encountered in fuel injectors. However, the chosen plastic material should be able to withstand the relatively high temperatures that exist adjacent the head of an internal combustion engine.

Metal tube 15 is preferably attached to interface plate 25 at a joint 29 such that the portion of nozzle supply passage 20 defined by interface plate 25 is aligned with the portion of nozzle supply passage 20 defined by metal tube 15. These components are preferably joined by laser welding, brazing or another suitable method that is capable of forming a secure metal to metal seal. In the illustrated embodiment, the end of the metal tube is welded inside of interface plate 25. One alternative might be to position the edge of the tube approximately flush with the bottom of the interface plate rather than in the middle as shown. An anchor 40, best illustrated in FIG. 1*a,* helps form a seal between plastic component 12 and interface plate 25. While anchor 40 has been illustrated as a ridge defined by interface plate 25 and a complementary ridge formed by plastic component 12, it should be appreciated that anchor 40 could instead take on any suitable shape or form.

Interface plate 25 is in turn attached to a tip 32 included in injector body 11 by a number of dowels 26 that are positioned to maintain the portion of nozzle supply passage 20 defined by tip 32 in alignment with the portion of nozzle supply passage 20 defined by interface plate 25. A casing 30 is utilized to form a metal to metal seal between interface plate 25 and tip 32. Casing 30 preferably has a number of internal threads that match a number of external threads provided on interface plate 25. It should be appreciated that the external threads are preferably positioned on interface plate 25 rather than plastic component 12 because the high loads necessary to make a reliable metal to metal seal between interface plate 25 and tip 32 are too high to be sustained by plastic component 12. However, an o-ring seal 27 is preferably positioned between casing 30 and plastic component 12. Those skilled in the art will appreciate that the external surfaces of plastic component 12 and interface plate 25 are generally cylindrical in shape.

Positioned within tip 32 and interface plate 25 is a needle valve 34. Needle valve 34 provides opening hydraulic surfaces 35 that are exposed to fluid pressure in nozzle chambers 37, defined by tip 32 to be in fluid communication with nozzle supply passage 20. Needle valve 34 is movable between a downward, closed position blocking nozzle supply passage 20 from a nozzle outlet 39 defined by tip 32, and an upward position opening nozzle outlet 39. Needle valve 34 is biased toward its downward, closed position by a biasing spring 19 that is positioned in plastic component 12. Biasing spring 19 is positioned between a stop component 16 and a spacer seal 24. Especially in the case where it is desirable to make the spring cage 17 a trapped volume, the spacer seal 24 preferably has a height taller than the height of interface plate 25. This slight height difference, which is exaggerated in FIG. 1, can aid in producing an annular seal against the bottom of the plastic component 12 in order to limit the migration of fuel that could cause the separation of the plastic 12 from the upper surface of interface plate 25 over time. Upward movement of needle valve 34 is limited by a lift pin 18 that is positioned in a spring cage 17 partially defined by plastic component 12 between stop component 16 and spacer seal 24. Stop component 16 defines the upper boundary of spring cage 17. In the illustrated embodiment, the spring cage is not vented so as to define a trapped volume that builds in pressure during an injection event to provide pressure assistance for needle closure at the end of the injection event. Between injection events, any residual pressure in the trapped volume spring cage leaks along the outer guide surface of the needle into nozzle chamber 37. One alternative might be to include a vent passage from the spring cage in the event that there is not a desire to exploit the trapped volume needle closure assistance technology.

Referring to FIG. 2, there is shown a fuel injector 110 according to an alternate embodiment of the present invention. As with fuel injector 10, fuel injector 110 provides an injector body 111 that has a metal tube 115 surrounded by a plastic component 112. Once again, metal tube 115 is preferably composed of steel and defines a nozzle supply passage 20. A first end of metal tube 115 defines a fuel inlet 114 and is attached to a coupling 13. Metal tube 115 also has a second end that is attached to a metal tip 132 provided in injector body 111. Preferably, metal tube 115 is attached to tip 132 by laser welding, or some other suitable method of forming a reliable metal to metal seal at joint 129.

Tip 132 is secured to plastic component 112 by an anchor 140, similar to that illustrated in FIGS. 1 and 1*a* to secure plastic component 12 to interface plate 25. Once again, while anchor 140 has been illustrated as a ridge defined by tip 132 and a complementary ridge formed by plastic component 112, it should be appreciated that anchor 140 could instead take on other suitable shapes or forms. A needle valve 34 is positioned in tip 132 and plastic component 112 and provides an opening hydraulic surface 35 that is exposed to fluid pressure in a nozzle chamber 37 that is defined by tip 132 to be in fluid communication with nozzle supply passage 20. Needle valve 34 is movable between a downward position, blocking a nozzle outlet 39 defined by tip 132, and an upward position, opening nozzle outlet 39. Needle valve 34 is biased toward its downward position by a biasing spring 19, positioned in plastic component 112. Needle valve 34 is limited in its upward movement by a lift pin 18 that is positioned between needle valve 34 and a stop component 16.

INDUSTRIAL APPLICABILITY

Referring to FIGS. 1 and 1*a*, assembly of fuel injector 10 will now be described according to the preferred method. Metal tube 15 is first attached to interface plate 25, preferably by laser welding. After attaching tube 15 to plate 25, the bottom surface of plate 25 is preferably ground to include a bottom planer surface that is substantially perpendicular to the centerline. Unlike some previous fuel injectors, the top surface of interface plate 25 need not be ground to the same precision as the bottom surface since one can expect the injection molded plastic to fill any surface irregularities that might exist. This assembly, along with stop component 16, is then cored into the mold for plastic component 12. Stop component 16 is preferably positioned in the mold apparatus by any conventional manner, such as by a vacuum, an electromagnetic force generated by a separate core piece, or by a mechanical fastener. Plastic component 12 is then formed in the mold apparatus around these components. As plastic component 12 sets, it forms around the ridge defined by interface plate 25 to create anchor 40.

Once plastic component 12 is set, the removable core is disconnected from stop component 16 and removed. Biasing spring 19 and lift pin 18 are then be inserted into plastic component 12 through interface plate 25. Spacer 22, needle valve 34 and spacer seal 25 are then inserted into plastic component 12 in a similar manner. Next, dowels 26 are inserted into their respective bores in interface plate 25, and tip 32 is positioned against interface plate 25 such that dowels 26 can extend into the corresponding bores defined by tip 32. Once tip 32 is positioned as desired, o-ring 27 is positioned in groove 28, and casing 30 is placed around tip 32, interface plate 25 and plastic component 12. Casing 30 is then torqued about the external threads defined by interface plate 25. With casing 30 secured about tip 32 and interface plate 25. Coupling 13 is then secured to metal tube 15, and fuel injector 10 is ready for use.

Referring to the embodiment of the present invention illustrated in FIG. 2, fuel injector 110 is assembled in a similar manner to fuel injector 10. Metal tube 115 is first attached to tip 132 by laser welding or some other suitable method. This assembly along with a removable core are set up in the injection mold apparatus for plastic component 112. As with plastic component 12, as plastic component 112 sets, it forms around the ridge defined by tip 132 to form anchor 140. Once plastic component 112 is set, needle valve 34, spacer 22, lift pin 18 and biasing spring 19 can be inserted into fuel injector 110 from above. Stop component 16 can then be inserted above biasing spring 19. Finally, a plug 113 is inserted into plastic component 112 adjacent stop component 16.

The present invention can reduce the number of machining steps necessary for production of pump and line type fuel injectors. For instance, in prior pump and line type fuel injectors, it was necessary to machine a spring cage having a perpendicularly oriented planar top. The method of injection molding plastic component 12 disclosed herein eliminates this need. Also, precise planar grinding of the top surface of the interface plate is no longer needed since the plastic should form around any surface irregularities. In addition, because the nozzle supply passage of the present invention is defined by a metal tube, there is no need to machine a relatively long nozzle supply passage in the injector body. This process traditionally required drilling a hole in both ends of the spring cage and intersecting these holes in the middle, which required an additional step of deburring the hole.

It should be understood that the above description is intended for illustrative purposes only, and is not intended to limit the scope of the present invention in any way. For instance, while the fuel injector of the present invention has been illustrated including a conventional needle valve member, it should be appreciated that the fuel injector could include an additional fluid inlet connected to the biasing surface of a direct control needle valve member. Further, while the anchor of the present invention has been illustrated as a ridge defined by a metal component and a complementary ridge defined by the plastic component, it should be appreciated that this element could take on a number of shapes or forms that would produce a reliable seal and connection. Thus, those skilled in the art will appreciate that other aspects, objects and advantages of this invention can be obtained from a study of the drawings, the disclosure and the appended claims.

What is claimed is:

1. A fuel injector component comprising:

a metal tube being at least partially surrounded by plastic;

said metal tube being attached to a metal component;

at least one of said plastic and said metal component partially define a spring cage; and a needle stop moldably attached to said plastic and defining an upper boundary of said spring cage.

2. A fuel injector comprising:

an injector body defining a nozzle outlet and including a metal tube attached to a metal component and being at least partially surrounded by plastic;

a needle valve member being movably positioned in said injector body; said metal tube includes a first end attached to said metal component and second end including a coupling;

wherein said metal component is secured to said plastic by an anchor defined by at least one of said metal component and said plastic;

at least one of said metal component and said plastic partially define a spring cage; and said needle valve member includes an opening hydraulic surface exposed to fluid pressure in said metal tube.

3. The fuel injector of claim 2 wherein said needle valve member is biased to a closed position blocking said nozzle outlet from said fuel supply passage by a biasing spring positioned in said spring cage.

4. The fuel injector of claim 3 wherein said injector body includes a tip that defines said nozzle outlet.

5. The fuel injector of claim 4 wherein said tip is secured to said metal component by a casing.

6. The fuel injector of claim 5 wherein said metal component includes a number of external threads and said casing includes a number of matching internal threads.

7. A fuel injector comprising:

a metal component with an elongated tip portion having an end the defines a plurality of nozzle outlets, and including a conical valve seat;

a needle valve member at least partially positioned in said metal component, and being movable into and out of contact with said conical valve seat;

a metal tube attached to, and extending away from, said metal component; and a plastic component attached to, and surrounding a portion of, said metal tube.

8. The fuel injector of claim 7 including a tube coupling positioned adjacent an exposed end of said metal tube.

9. The fuel injector of claim 7 wherein said needle valve member includes an opening hydraulic surface exposed to fluid pressure in a fuel supply passage disposed in said metal component and said metal tube.

10. The fuel injector of claim 7 wherein said needle valve member has an end exposed to fluid pressure in a trapped volume disposed in at least one of said metal component and said plastic component.

* * * * *